US008167689B2

(12) United States Patent
Hofmann et al.

(10) Patent No.: US 8,167,689 B2
(45) Date of Patent: May 1, 2012

(54) SYSTEM WITH A TOOL-HOLDING FIXTURE

(75) Inventors: Albrecht Hofmann, Steinenbronn (DE); Harald Krondorfer, Mundelein, IL (US); Markus Heckmann, Leinfelden-Echterdingen (DE); Thomas Schomisch, Leinfelden-Echterdingen (DE)

(73) Assignees: Robert Bosch GmbH, Stuttgart (DE); Tyrolit Schleigmitel Swarowski K.G., Schwaz (AT)

( * ) Notice: Subject to any disclaimer, the term of this patent is extended or adjusted under 35 U.S.C. 154(b) by 1592 days.

(21) Appl. No.: 10/511,285

(22) PCT Filed: Apr. 2, 2003
(Under 37 CFR 1.47)

(86) PCT No.: PCT/DE03/01079
§ 371 (c)(1),
(2), (4) Date: Jan. 17, 2007

(87) PCT Pub. No.: WO03/097299
PCT Pub. Date: Nov. 27, 2003

(65) Prior Publication Data

US 2011/0097978 A1 Apr. 28, 2011

(30) Foreign Application Priority Data

May 18, 2002 (DE) ..... 102 22 292

(51) Int. Cl.
*B24B 41/02* (2006.01)

(52) U.S. Cl. ..... 451/363; 451/359; 451/360

(58) Field of Classification Search ..... 451/360, 451/363, 359, 358, 344, 541
See application file for complete search history.

(56) References Cited

U.S. PATENT DOCUMENTS

| | | | | |
|---|---|---|---|---|
| 3,270,467 | A | 9/1966 | Block et al. | |
| 3,623,281 | A * | 11/1971 | Moffat | 451/509 |
| 4,657,428 | A * | 4/1987 | Wiley | 403/359.3 |
| 4,730,952 | A * | 3/1988 | Wiley | 403/316 |
| 5,681,213 | A | 10/1997 | Hashii | |
| 5,733,183 | A | 3/1998 | Schierling et al. | |
| 6,332,836 | B1 * | 12/2001 | Tseng | 451/359 |
| 6,523,214 | B1 * | 2/2003 | Kaiser | 15/230 |
| 6,869,346 | B2 | 3/2005 | Wendt et al. | |
| 2002/0009965 | A1 | 1/2002 | Braasch | |
| 2003/0129933 | A1 | 7/2003 | Wendt et al. | |

FOREIGN PATENT DOCUMENTS

| | | |
|---|---|---|
| DE | 195 04 563 | 8/1996 |
| DE | 100 17 457 | 10/2001 |
| EP | 0 904 896 A2 | 3/1999 |
| EP | 1 174 219 A2 | 1/2002 |
| WO | 01/96067 A1 | 12/2001 |

* cited by examiner

*Primary Examiner* — Dung Van Nguyen
(74) *Attorney, Agent, or Firm* — Michael J. Striker

(57) ABSTRACT

The invention is based on a system with a tool-holding fixture, which fixture has a slaving device (12) by way of which an inserted tool (14) can be connected operatively to a drive shaft (16), and with an inserted tool (14) which can be connected operatively to the slaving device (12) via at least one detent element (20) that is supported movably counter to a spring element (18), which detent element snaps into place in an operating position of the inserted tool (14) and fixes the inserted tool (14) by positive engagement.

Figure 1:
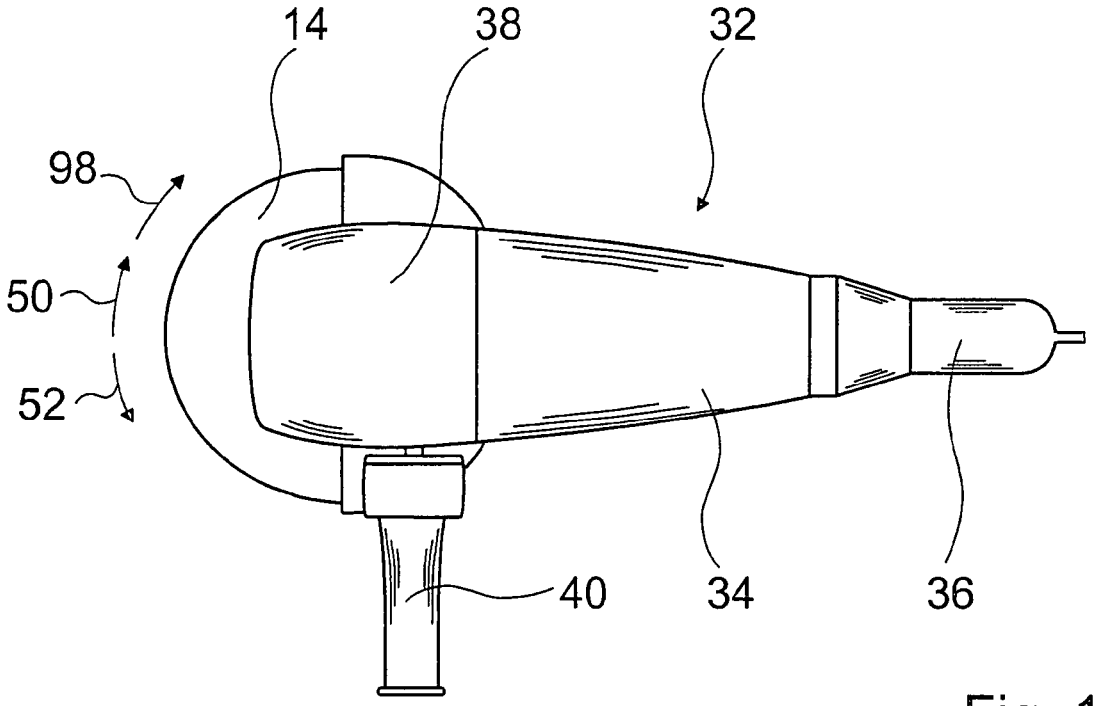

It is proposed that the tool-holding fixture and the inserted tool (14) have at least two corresponding shaped elements (22, 24), adapted to one another, to facilitate installation of the inserted tool (14).

10 Claims, 3 Drawing Sheets

SYSTEM WITH A TOOL-HOLDING FIXTURE

PRIOR ART

The invention is based on a system with a tool-holding fixture as generically defined by the preamble to claim 1.

From European Patent Disclosure EP 0 904 896 A2, a system with a grinding machine tool-holding fixture for a hand-guided angle grinder and with a grinding wheel is known. The angle grinder has a drive shaft which has a thread toward the tool.

The grinding machine tool-holding fixture has a slaving means and a clamping nut. For installing the grinding wheel, the slaving means is slipped with an installation opening onto a collar of the drive shaft and braced by nonpositive engagement via the clamping nut against a contact face of the drive shaft. The slaving means has a collar extending in the axial direction toward the tool, and the collar has recesses, radially on two opposite sides of its outer circumference, which extend in the axial direction as far as a base of the collar. Beginning at the recesses, one groove each extends on the outer circumference of the collar in the direction opposite the drive device of the drive shaft. The grooves are closed counter to the drive device of the drive shaft and taper axially, beginning at the recesses, opposite the drive device of the drive shaft.

The grinding wheel has a hub with an installation opening, in which two opposed, radially inward-pointing tongues are disposed. The tongues can be introduced in the axial direction into the recesses and then in the circumferential direction, counter to the drive device, into the grooves. Via the tongues, the grinding wheel is fixed by positive engagement in the axial direction in the grooves and by nonpositive engagement as a result of the tapering contour of the grooves. During operation, the nonpositive engagement increases, because of reaction forces acting on the grinding wheel that are exerted counter to the drive device.

To prevent the grinding wheel from wearing down when the drive shaft is braked by the slaving means, a stopper is disposed in the region of one recess on the circumference of the collar and is supported movably in the axial direction in an opening. In a working position that points downward with the grinding wheel, the stopper is deflected by gravity axially in the direction of the grinding wheel and closes the groove in the direction of the recess and blocks any motion of the tongue located in the groove in the drive device of the drive shaft.

ADVANTAGES OF THE INVENTION

The invention is based on a system with a tool-holding fixture, which fixture has a slaving device by way of which an inserted tool can be connected operatively to a drive shaft, and with an inserted tool which can be connected operatively to the slaving device via at least one detent element that is supported movably counter to a spring element, which detent element snaps into place in an operating position of the inserted tool and fixes the inserted tool by positive engagement.

It is proposed that the tool-holding fixture and the inserted tool have at least two corresponding shaped elements, adapted to one another, to facilitate installation of the inserted tool. Advantageous, simple installation of the inserted tool is attainable, especially because the shaped elements form a guide, so that clamping hooks of the slaving device can automatically engage corresponding recesses in the hub.

Advantageously, the corresponding shaped elements, with respect to at least one parameter, form a coding means to prevent an incorrect inserted tool of the same type from being installed. In a structurally simple way, protection for a power tool and for the inserted tool against damage and/or destruction from any defective load, such as an excessively high rpm, can be attained. Coding on the basis of various parameters that appear appropriate to one skilled in the art is conceivable, such as dimensioning of the inserted tool, a maximum allowable rpm, an intended use of the inserted tool, a material to be machined, and so forth. Electronic coding means are also conceivable, with which an rpm of a motor or of a drive unit, for instance, can be limited as a function of the inserted tool, or a power supply can be disrupted if an incorrect inserted tool is used.

Advantageously, the corresponding shaped elements are adapted to one another in terms of the dimensioning of the inserted tool, and as a result, in particular, a correct association of a diameter of the inserted tool with an rpm of the power tool can be assured, and damage can be avoided. Besides the diameter, however, still other dimensions are conceivable as a coding criterion, such as a thickness of the inserted tool in particular.

Advantageously, the shaped element disposed on the tool-holding fixture is formed by a radially extending protrusion disposed on a collar of the tool-holding fixture, and the shaped element disposed on the inserted tool is formed by a recess. Large-area centering faces for simple, secure installation of the inserted tool in the tool-holding fixture are attainable. However, it is also conceivable for a protrusion that extends radially inward to be formed onto the hub or the inserted tool, and for a recess to be formed onto the tool-holding fixture.

In a further feature of the invention, it is proposed that the protrusion has a spacing in the axial direction from a contact face. To attain a locking position, the inserted tool can be rotated until it is under the protrusion. The protrusion represents an additional means of securing the inserted tool and makes an additional contribution to safety for the user.

It is also proposed that at least three protrusions distributed uniformly over the circumference are disposed on the tool-holding fixture. The three protrusions cover an unambiguously defined plane and with their face ends form an advantageous contact face for the inserted tool. Upon installation in the tool-holding fixture, the inserted tool can simply be placed on the contact face and rotated, until the shaped elements are in a position corresponding to one another. This makes it much easier to find the appropriate recesses in the hub and thread the retaining hooks into them, and jamming and tilting of the inserted tool upon installation can advantageously be avoided.

The protrusion may be formed onto a separate component or advantageously may be embodied integrally with the tool-holding fixture; in the latter case, additional components, installation effort and expense can be saved.

In a further feature of the invention, it is provided that a cylindrical part of the collar protrudes in the axial direction past end faces of the shaped elements.

DRAWING

Further advantages will become apparent from the ensuing drawing description. In the drawing, one exemplary embodiment of the invention is shown. The drawing, description and claims include numerous characteristics in combination. One skilled in the art will expediently consider the characteristics individually as well and put them together to make useful further combinations.

Figure 2:
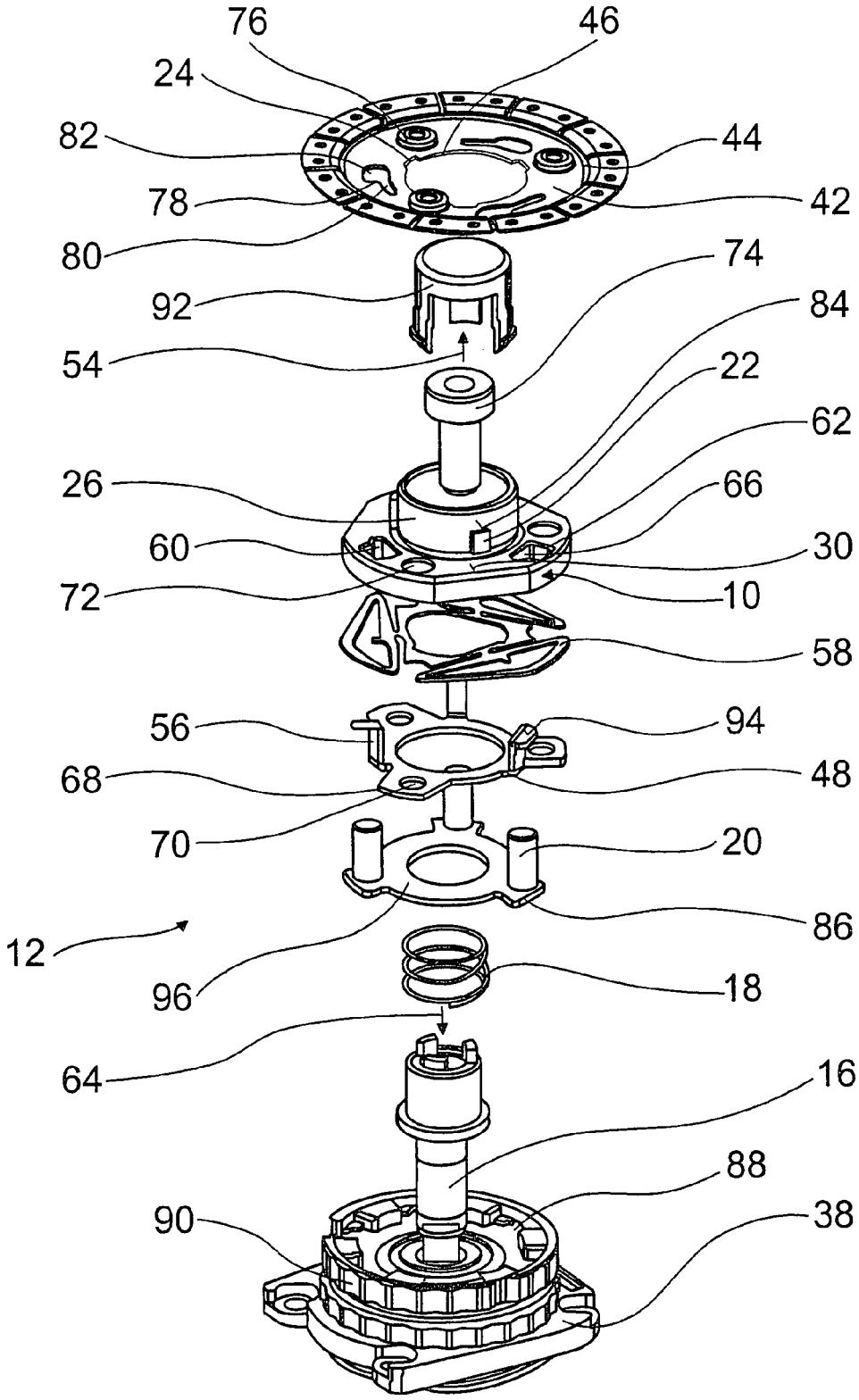
Figure 3:
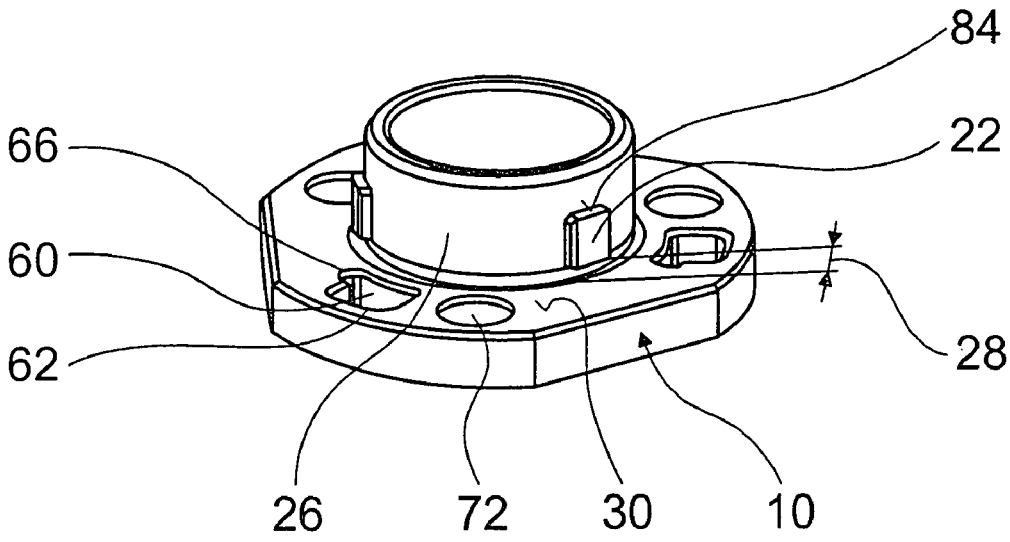

Shown are:

FIG. 1, an angle grinder, shown schematically from above;

FIG. 2, an exploded view of a system with a tool-holding fixture;

FIG. 3, an enlarged illustration of a slaving flange of FIG. 2.

DESCRIPTION OF THE EXEMPLARY EMBODIMENT

FIG. 1 shows an angle grinder 32 from above, with an electric motor, not further shown, supported in a housing 34. The angle grinder 32 can be guided via a first handle 36, extending longitudinally and integrated with the housing 34 on a side remote from an inserted tool 14, and via a second handle 40, extending transversely to the longitudinal direction and secured on a gear housing 38 in the region of the inserted tool 14. With the electric motor, via a gear not further shown, a drive shaft 16 can be driven, on whose end pointing toward the inserted tool 14 there is a tool-holding fixture with a slaving device 12 (FIG. 2). The tool-holding fixture and the inserted tool 14 form one system.

The tool-holding fixture has a slaving flange 10, which forms a contact face 30 for the inserted tool 14 (FIG. 2 and FIG. 3). On the slaving flange 10, on a side toward the inserted tool 14, a collar 26 is formed on, and by way of it the inserted tool 14 is centered radially in the installed state with its centering bore 46. Three shaped elements 22 are disposed on the collar 26; they are formed by protrusions extending radially outward. The shaped elements 22 embodied integrally with the collar 26 are distributed uniformly over an outer circumference of the collar 26 and have a spacing 28 from the contact face 30 in the axial direction 54, 64. With its end pointing toward the inserted tool 14, the collar 26 protrudes past the shaped elements 22 in the axial direction 54.

On a side of the slaving flange 10 remote from the inserted tool 14, there is a sheet-metal plate 48, with three integrally formed-on clamping hooks 56, distributed uniformly in the circumferential direction 50, 52 and extending in the axial direction 54, for the axial fixation of the inserted tool 14. The clamping hooks 56 are formed onto the sheet-metal plate 48 in a bending operation.

In the assembly of the slaving device 12, the slaving flange 10, a spring element 58, and the sheet-metal plate 48 are preassembled. In the process, the spring element 58 is thrust onto a collar, not identified by reference numeral, of the slaving flange 10 that points in the direction away from the inserted tool 14. Next, the clamping hooks 56 of the sheet-metal plate 48, which on their free end have a hook-shaped extension with an oblique face 94 pointing in the circumferential direction 52, are guided in the axial direction 54 through recesses 60 of the slaving flange 10, specifically through widened regions 62 of the recesses 60 (FIGS. 2 and 3). By pressing the sheet-metal plate 48 and the slaving flange 10 together and rotating them counter to one another, the spring element 58 is prestressed, and the sheet-metal plate 48 and the slaving flange 10 are joined by positive engagement in the axial direction 54, 64, specifically by rotating the hooklike extensions into narrow regions 66 of the recesses 60 (FIGS. 2 and 3). The sheet-metal plate 48 is then, loaded by the spring element 58, braced on the contact face 30 of the slaving flange 10 via edges of the hooklike extensions that point in the direction away from the inserted tool 14.

Once the spring element 58, the slaving flange 10, and the sheet-metal plate 48 having the formed-on clamping hooks 56 have been preinstalled, a spring element 18 formed by a helical spring and a slaving disk 96, with three bolts extending in the axial direction 54 and distributed uniformly over the circumference, are slipped onto a drive shaft 16 (FIG. 2).

Next, the preinstalled structural group comprising the sheet-metal plate 48, spring element 58 and slaving flange 10, are installed on the drive shaft 16. In the installation, the bolts 20 are guided by tabs 68, which have bores 70 and are formed onto the circumference of the sheet-metal plate 48, and by through bores 72 located in the slaving flange 10, and in the installed state they reach through the through bores 72. The sheet-metal plate 48 and the slaving disk 96 are secured against rotation relative to one another via the bolts 20.

The tool-holding fixture is secured on the drive shaft 16 with a screw 74. The inserted tool 14, formed by a cutting disk, has a sheet-metal hub 42, formed by a separate component, that has three bowl-shaped recesses 76, distributed uniformly in the circumferential direction 50, 52 one after the other and extending in the axial direction 54, and their diameter is slightly larger than the diameter of the bolts 20. The sheet-metal hub 42 also has three recesses 78, extending in the circumferential direction 50, 52 and distributed uniformly in the circumferential direction 50, 52, which each have one narrow region and one wide region 80, 82, respectively.

The diameter of the centering bore 46 of the sheet-metal hub 42 is selected such that the inserted tool 14 can be clamped to a conventional power angle grinder even with a conventional clamping system that has a clamping flange and a spindle nut. This assures so-called downward compatibility.

The sheet-metal hub 42 of the inserted tool 14 has three shaped elements 24, which are distributed uniformly in the circumferential direction 50, 52 over the circumference of the centering bore 46 (FIG. 2). The shaped elements 24 are formed here by recesses.

The shaped elements 22 of the tool-holding fixture and the shaped elements 24 of the inserted tool 14 are corresponding shaped elements adapted to one another, to facilitate installation of the inserted tool 14. The corresponding shaped elements 22, 24 furthermore form a coding means to prevent the installation of an incorrect inserted tool of the same type. For that purpose, the corresponding shaped elements 22, 24 are adapted to one another in terms of a diameter of the inserted tool 14, so that inserted tools for use in high-speed machines have a wide shaped element or a wide coding means, and inserted tools for use in lower-speed machines have a narrow shaped element or a narrow coding means.

The sheet-metal hub 42 of the inserted tool 14 is firmly connected via a rivet connection to a grinding means and compressed and is embodied in bowl-like form by an indentation 44 pointing in the axial direction 64.

Upon installation of the inserted tool 14, the inserted tool 14 is thrust with its centering bore 46 onto the part of the collar 26 protruding past the shaped elements 22 in the axial direction 54 and is radially precentered. In the process, the inserted tool 14 comes to rest on contact faces 84 of the shaped elements 22. Rotating the inserted tool 14 in the circumferential direction 50, 52 causes the shaped elements 22, 24 to coincide. The inserted tool 14 or the sheet-metal hub 42 can then slide in the axial direction 64 in the direction of the contact face 30, and the sheet-metal hub 42 comes to rest on the bolts 20. Subsequently pressing the sheet-metal hub 42 against the contact face 30 of the slaving flange 10 causes the bolts 20 to be displaced into the through bores 72 and causes the slaving disk 96 to be displaced axially, counter to a spring force of the spring element 18, on the drive shaft 16 in the direction 64 remote from the inserted tool 14. In the process, radially outward-oriented recesses 86 in the slaving disk 96 engage corresponding locking pockets 88 of a bearing flange 90, which is firmly joined to the gear housing 38, and lock the drive shaft 16.

When the sheet-metal hub 42 is pressed down onto the contact face 30, the clamping hooks 56 automatically move into the wide regions 82 of the recesses 78 in the sheet-metal hub 42.

If the hooklike extensions of the clamping hooks 56 are guided by the wide regions 82 of the recesses 78 of the sheet-metal hub 42, and if the sheet-metal hub 42 has been pressed all the way down, then the sheet-metal hub 42 can be rotated counter to a drive device 98. The rotation of the sheet-metal hub 42 has the effect first that the sheet-metal hub 42, with its edge of the centering bore 46, can slide at the spacing 28 between the shaped elements 22 and the contact face 30 of the slaving flange 10 and can be secured against falling downward in the axial direction by the shaped elements 22. Second, the rotation of the sheet-metal hub 42 has the effect that the hooklike extensions are displaced into the curved narrow regions 80 of the recesses 78 in the sheet-metal hub 42. In the process, the sheet-metal plate 48 with the clamping hooks 56 is displaced axially, by oblique faces not identified by reference numeral, counter to the pressure of the spring element 58 in the direction 54, until contact faces of the hooklike extensions come to rest in the curved narrow regions 80, laterally beside the recesses 78 in the sheet-metal hub 42.

In an operating position of the inserted tool 14, the pressure of the spring element 18 causes the slaving disk 96 to slide upward. The bolts 20 snap into place in the bowl-shaped recesses 76 of the sheet-metal hub 42 and secure this sheet-metal hub in the circumferential direction 50, 52 by positive engagement. At the same time, the recesses 86 in the slaving disk 96 come out of engagement with the locking pockets 88 of the bearing flange 90 and release the drive shaft 16.

For removal of the inserted tool 14, an unlocking button 92 is pressed in the axial direction 64. The unlocking button 92 presses the slaving disk 96 in the axial direction 64, and the recesses 86 in the slaving disk 96 come into engagement with the locking pockets 88. The drive shaft 16 is locked. The bolts 20 in this process come out of engagement with the recesses 76 in the sheet-metal hub 42, and the sheet-metal hub 42 can be rotated in the circumferential direction 52 until the clamping hooks 56 can slide through the recesses 78. In this process, the shaped elements 22, 24 slide into a corresponding position, and the sheet-metal hub 42 can be removed in the axial direction 54.

LIST OF REFERENCE NUMERALS

10 Slaving flange
12 Slaving device
14 Inserted tool
16 Drive shaft
18 Spring element
20 Detent element
22 Shaped element
24 Shaped element
26 Collar
28 Spacing
30 Contact face
32 Angle grinder
34 Housing
36 Handle
38 Gear housing
40 Handle
42 Hub
44 Indentation
46 Centering bore
48 Sheet-metal plate
50 Circumferential direction
52 Circumferential direction
54 Axial direction
56 Clamping hook
58 Spring element
60 Recess
62 Region
64 Axial direction
66 Region
68 Tab
70 Bore
72 Through bore
74 Screw
76 Recess
78 Recess
80 Region
82 Region
84 Contact face
86 Recess
88 Locking pocket
90 Bearing flange
92 Unlocking button
94 Oblique face
96 Slaving disk
98 Drive device

The invention claimed is:

1. A system for operatively connecting an inserted tool to a drive shaft, comprising:

a tool-holding fixture having a slaving flange (10) and a slaving device (12) comprising a spring element (18) and at least one detent element (20); and an inserted tool (14) which can be connected operatively to the slaving device (12) via the at least one detent element (20) that is supported movably counter to the spring element (18);

wherein the inserted tool (14) can be connected operatively to a drive shaft (16) via the slaving device (12), wherein the detent element (20) snaps into place in an operating position of the inserted tool (14) and fixes the inserted tool (14) by positive engagement, wherein the tool-holding fixture and the inserted tool (14) have at least two corresponding shaped elements (22, 24), adapted to one another, to facilitate installation of the inserted tool (14), wherein the shaped element (22) arranged on the tool-holding fixture is formed by a radially extending protrusion arranged on a collar (26) of the slaving flange (10), wherein the shaped element (24) arranged on the inserted tool (14) is formed by a recess, and wherein a cylindrical part of the collar (26) of the slaving flange (10) protrudes in an axial direction past an end face (84) of the shaped element (22) embodied as the radially extending protrusion.

2. The system of claim 1, wherein the corresponding shaped elements (22, 24) are adapted to one another in terms of a diameter of the inserted tool (14) to prevent installation of an incorrect inserted tool of the same type such that inserted tools for use in high-speed machines have a wide shaped element and inserted tools for use in lower-speed machines have a narrow shaped element.

3. The system of claim 1, wherein the protrusion (22) has a spacing (28) in the axial direction from a contact face (30) of the slaving flange (10).

4. The system of claim 1, wherein at least three protrusions (22) arranged at the collar (26) of the slaving flange (10) are distributed uniformly over an outer circumference of the collar (26).

5. The system of claim 1, wherein the protrusion (22) is embodied integrally with the collar (26) of the slaving flange (10) the tool-holding fixture.

6. The system of claim 1, wherein the tool-holding fixture further comprises a slaving disk (96) including at least three detent elements embodied as bolts (20) which, in a mounted state, extend in the axial direction and which are distributed uniformly over a circumference of the slaving disk (96).

7. The system of claim 6, wherein the inserted tool (14) comprises a sheet-metal hub (42) having at least three bowl-shaped recesses (76) in which the bolts (20) engage in at least one operating mode, wherein the at least three bowl-shaped recesses (76) are distributed uniformly in a circumferential direction (50, 52) one after the other and extend in the axial direction.

8. The system of claim 1, wherein the tool-holding fixture further comprises a sheet-metal plate (48) having at least three integrally formed-on clamping hooks (56) distributed uniformly in a circumferential direction (50, 52) and extending in an axial direction, for an axial fixation of the inserted tool (14).

9. The system of claim 8, wherein the tool-holding fixture further comprises a further spring element (58) to load the sheet-metal plate (48) with a spring load acting against a spring load of the spring element (18).

10. The system of claim 8, wherein the inserted tool (14) comprises a sheet-metal hub (42) having at least three recesses (78) in which the clamping hooks (56) engage in at least one operating mode, wherein the at least three recesses extend in the circumferential direction (50, 52) and are distributed uniformly in the circumferential direction (50, 52), wherein each of the at least three recesses (78) has one narrow region and one wide region (80, 82).

* * * * *